US006475033B1

(12) United States Patent
Zhu et al.

(10) Patent No.: US 6,475,033 B1
(45) Date of Patent: Nov. 5, 2002

(54) ELECTRICAL CONNECTOR

(75) Inventors: ZiQiang Zhu, Kunsan (CN); Jinkui Hu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/975,330

(22) Filed: Oct. 10, 2001

(51) Int. Cl.[7] ..... H01R 13/648
(52) U.S. Cl. ..... 439/607
(58) Field of Search ..... 439/607, 608, 439/79, 676

(56) References Cited

U.S. PATENT DOCUMENTS 5,725,386 A * 3/1998 Davis et al. ..... 439/607
5,934,940 A * 8/1999 Maranto et al. ..... 439/108
5,961,350 A * 10/1999 Shiu ..... 439/108
5,993,258 A * 11/1999 Matsunuma et al. ..... 439/607
6,059,581 A * 5/2000 Wu ..... 439/607
6,203,373 B1 * 3/2001 Lin ..... 439/607
6,210,224 B1 * 4/2001 Wu ..... 439/607
6,305,984 B1 * 10/2001 Katoh et al. ..... 439/108

* cited by examiner

*Primary Examiner*—Tulsidas Patel
(74) *Attorney, Agent, or Firm*—Wei Te Chung

(57) ABSTRACT

An electrical connector includes an insulative housing (1) defining a plurality of passageways (13) for receiving a corresponding plurality of the contacts (2), and a shielding shell (3) enclosing the insulative housing (1). The shielding shell (3) has a bottom wall (33) having a front portion and a rear portion. A plurality of board mounting legs (331, 332) downwardly extends from the front portion and the rear portion of the bottom wall. Major surfaces of the front legs (331) and the rear legs (332) are substantially perpendicular to each other. When the connector is mounted on a printed circuit board (4), the board mounting legs (331, 332) are soldered to the printed circuit board (4). With the addition of the front legs (331), the connector can be more stably mounted on the printed circuit board (4).

9 Claims, 5 Drawing Sheets

ELECTRICAL CONNECTOR

BACKGROUND OF THE INVENTION

1. Field of the Invention

The present invention relates to an electrical connector, and more particularly to a Universal Ser. Bus (USB) connector which can be stably mounted on a printed circuit board (PCB).

2. Description of the Related Art

A conventional USB connector is retained on a PCB by a pair of legs extending downward from a bottom wall of a shell of the connector. For example, U.S. Pat. No. 5,779,489 and Taiwan Pat. Application No. 86214395 disclose connectors of such kind. FIG. 1 of the attached drawings shows the electrical connector of Taiwan Pat. Application No. 86214395, which comprises an insulative housing 101, a plurality of contacts 102, and first and second shielding shells 103, 104 enclosing the insulative housing 101. A pair of board mounting legs 105 extends downward respectively from side walls of the second shell 104 for retaining the connector on a PCB (not shown) before soldering is performed.

However, when a mating connector is forcibly inserted into the connector, there will be excessive force and torque occurring in the board mounting legs. Such a force may cause deformation of the mating portion and even separate the board mounting legs from the PCB. Hence, an improved electrical connector is required to overcome the disadvantages of the conventional connector.

SUMMARY OF THE INVENTION

Accordingly, it is an object of the present invention to provide an electrical connector which can be stably mounted on a printed circuit board for ensuring proper resistance of board mounting legs against the force applied thereto.

To achieve the above object, an electrical connector in accordance with the present invention comprises an insulative housing, a plurality of contacts, and a shielding shell enclosing the insulative housing. The insulative housing comprises a base section and a mating section extending forward from the base section. A plurality of passageways is defined in the mating section for receiving and retaining the contacts. Each contact has a mating portion for electrically engaging with a mating connector, and a tail portion extending beyond a bottom wall of the housing for electrically connecting with a PCB. The insulative housing has a bottom face wherefrom downwardly extending a plurality of standoffs. The shielding shell comprises two side walls connected by a top wall and a bottom wall defining a chamber therebetween for receiving the insulative housing. The bottom wall of the shell has front and rear portion from which a plurality of front and rear board mounting legs downwardly extends. When the connector is mounted onto the printed circuit board, the board mounting legs engages holes defined in the PCB for temporarily retaining the connector on the PCB. A soldering process may then be taken to more securely retain the connector on the PCB. The provision of the front legs effectively reduce load taken by the rear legs alone.

Other objects, advantages and novel features of the invention will become more apparent from the following detailed description of a preferred embodiment thereof when taken in conjunction with the accompanying drawings,

DETAILED DESCRIPTION OF PREFERRED EMBODIMENT OF THE INVENTION

Figure 1:
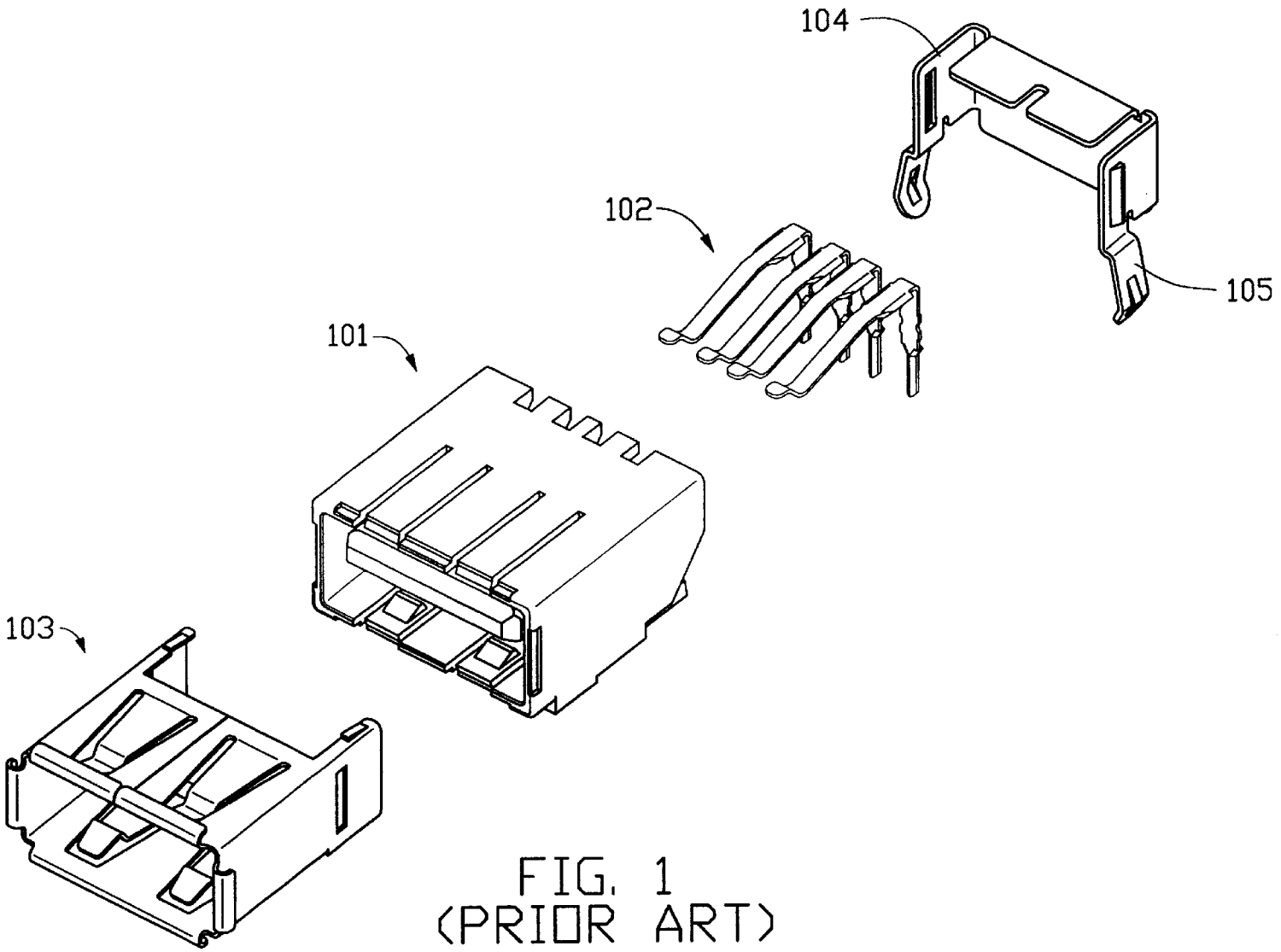
FIG. 1 (PRIOR ART)
FIG. 1 is an exploded perspective view of an conventional electrical connector.
Figure 2:
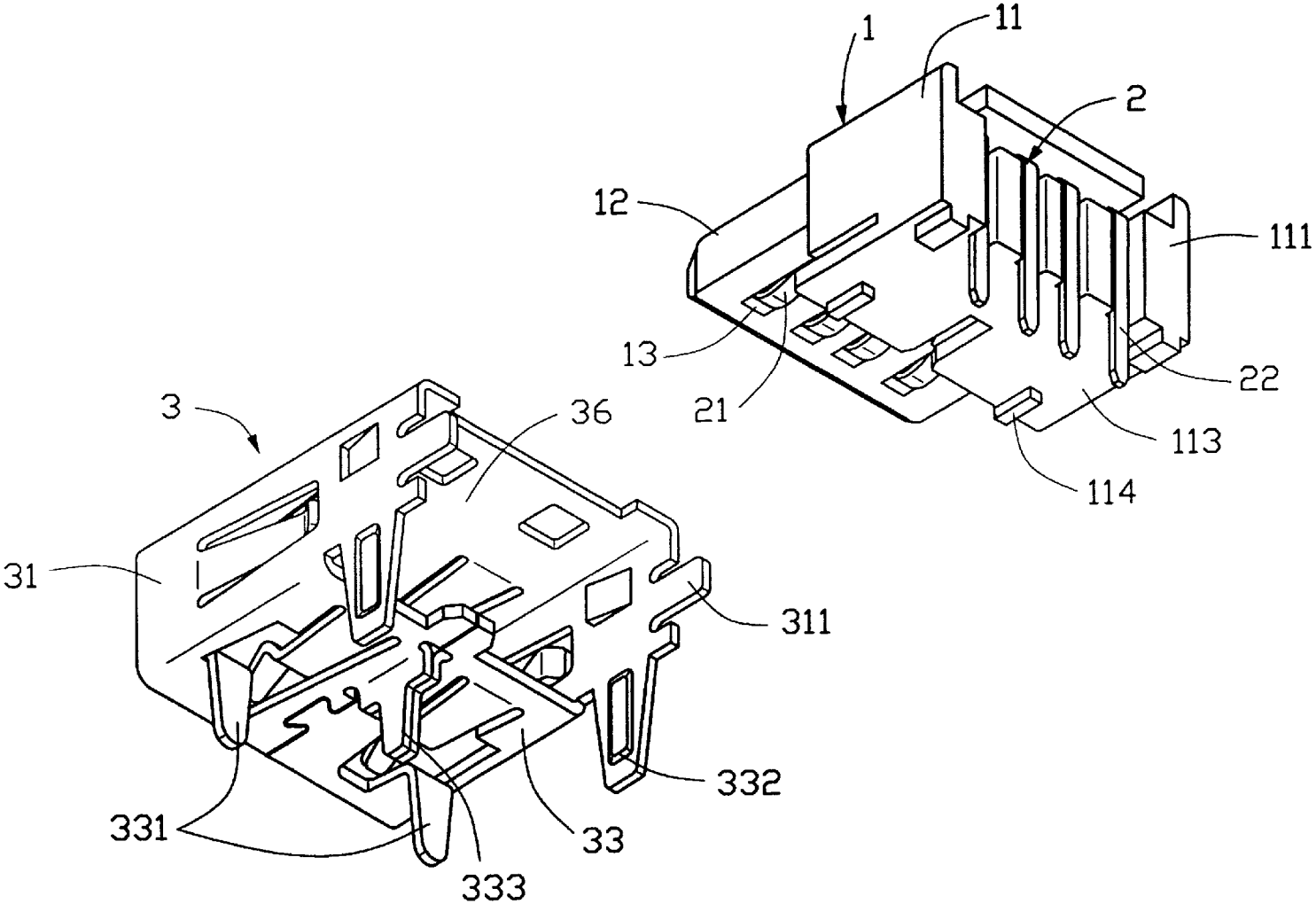
FIG. 2 is an exploded perspective view of an electrical connector in accordance with the present invention.

Referring to FIG. 2, an electrical connector in accordance with the present invention comprises an insulative housing 1, a plurality of contacts 2 retained in the housing 1, and a shielding shell 3 enclosing the insulative housing 1. The insulative housing 1 comprises a base section 11 having a front face (not labeled) from which a mating section 12 forwardly extends, and a back face 111 and a bottom face 113. The mating section 12 has opposite surfaces. A plurality of passageways 13 is formed in one of the surfaces for receiving the contacts 2. Each contact 2 has a mating portion 21 for electrically engaging with a mating connector (not shown) and a tail portion 22 extending beyond the bottom face 113 of the base section 11 for electrically connecting with a printed circuit board (PCB) 4 (see FIG. 5). A plurality of standoffs 114 is formed on and downwardly extends from the bottom face 113 of the housing 1.

Figure 3:
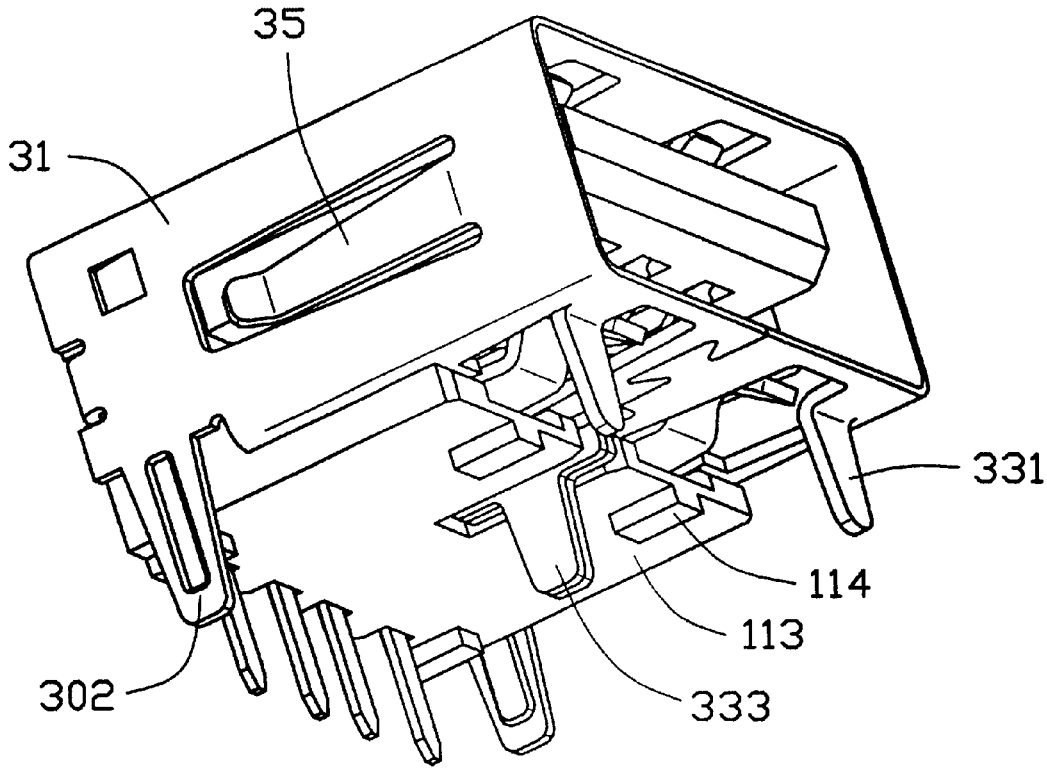
FIG. 3 is an assembled view of the electrical connector of FIG. 1.
Figure 4:
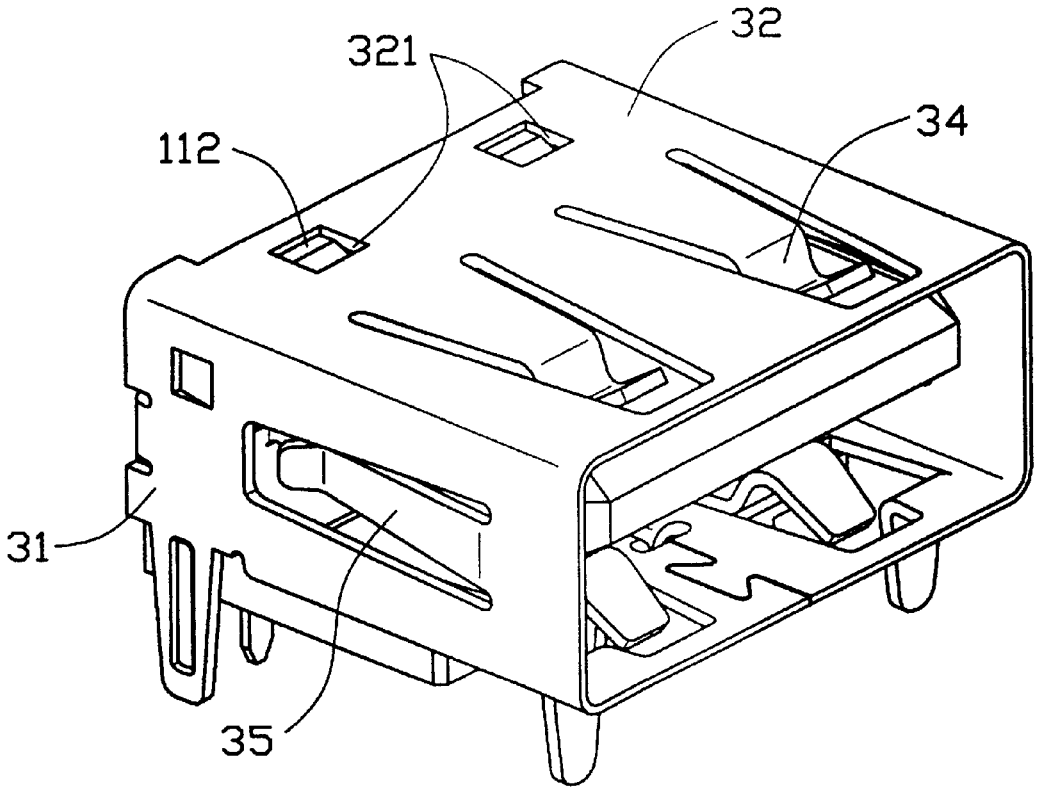
FIG. 4 is a view similar to FIG. 3 but taken from a different perspective.
Figure 5:
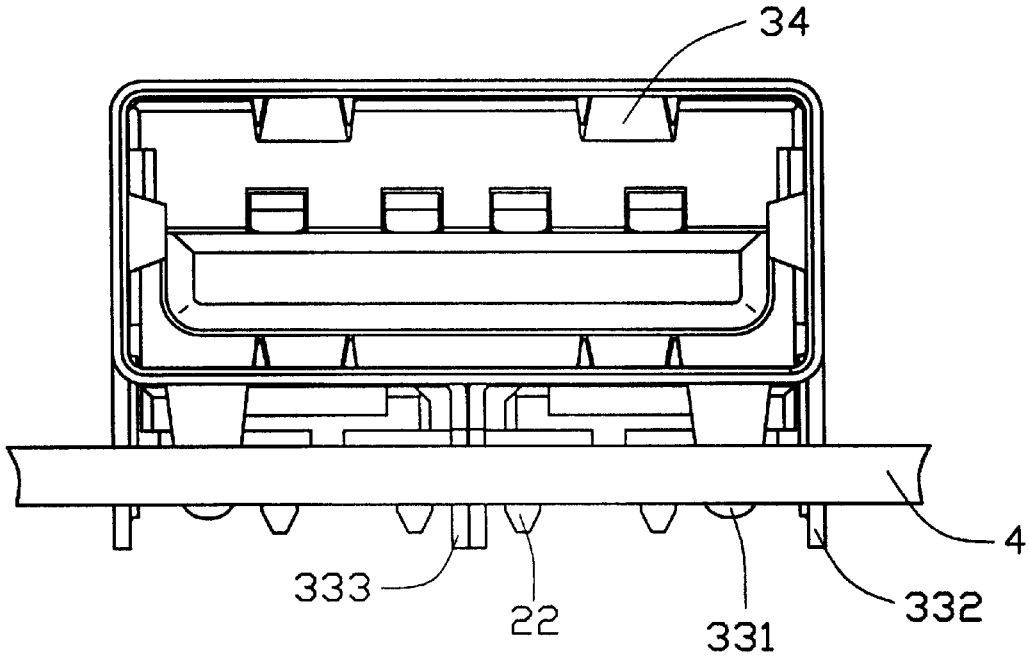
FIG. 5 is a front view of the electrical connector retained on a printed circuit board.

Referring to FIGS. 3, 4 and 5, the shielding shell 3 comprises two side walls 31 connected together by a top wall 32 (FIG. 4) and a bottom wall 33 defining a chamber 36 therebetween for receiving the housing 1. A pair of resilient tangs 34 is stamped respectively from the top wall 32 and the bottom wall 33 for engaging with the mating connector, and another pair of resilient tangs 35 is stamped from the two side walls 31 for engaging with and retaining the housing 1. A pair of holes 321 is defined in the top wall 32 proximate to a rear edge thereof for engaging with corresponding projections 112 formed on the housing 1 to secure the shell 3 to the housing 1. A pair of tabs 311 backwardly extends respectively from the two side walls 31 for engaging the rear face 111 of the housing 1 to retain the housing 1 in the chamber 36. A plurality of rear board mounting/locking legs 332 is formed and downward extending from a rear portion of the bottom wall 33 and the side walls 31 of the shell 3. A major surface of the rear legs 332 is substantially coplanar with the corresponding side walls 31. In accordance with the present invention, to ensure more stable fixation of the connector on the printed circuit board 4, a plurality of front board mounting/locking legs 331 are formed by stamping the bottom wall 33 whereby a major surface of the front legs 331 is substantially extending in a direction between the opposite side walls 31 of the shell 3. Thus, the major surfaces of the front legs 331 and the rear legs 332 are substantially perpendicular to each other. If desired, the rear portion of the bottom wall 33 can also form another board mounting leg 333 .

Referring to FIGS. 2 to 5, in assembly, the insulative housing 1 is inserted in the chamber 36 of the shielding shell 3 with the projections 112 of the housing 1 respectively received and engaging with the corresponding holes 321 of the shell 3. The tabs 311 of the two side walls 31 are bent to engage with the housing 1 thereby securely retaining the housing 1 in the shell 3.

When the electrical connector is mounted on the PCB 4, the tail portion 22 of each contact 2 is received within a corresponding hole (not shown) of the PCB 4 for electrically connecting with the PCB 4. The standoffs 114 of the insulative housing 1 abut against the PCB 4 for spacing the connector from the PCB 4 a predetermined distance. The board mounting legs 331, 332 and 333 are then soldered to the corresponding PCB 4 for securely mounting the electrical connector on the PCB 4.

It is to be understood, however, that even thought characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A Universal Serial Bus (USB) connector, comprising:

an insulative housing defining a plurality of passageways therein;

a plurality of contacts received in the passageways of the insulative housing;

a shielding shell enclosing the insulative housing and comprising two opposite side walls and a bottom wall, a plurality of rear board mounting legs downwardly extending from a rear portion of the side walls; and a plurality of spaced front board mounting legs downwardly extending from a front portion of the bottom wall of the shielding shell, each front board mounting leg having a major surface substantially perpendicular to a major surface of each rear board mounting leg.

2. The USB connector as claimed in claim 1, wherein the plurality of front board mounting legs has two front board mounting legs.

3. The USB connector as claimed in claim 1, wherein the shielding shell has a top wall opposite to the bottom wall thereof, each wall forming a plurality of resilient tangs.

4. The USB connector as claimed in claim 1, wherein the shielding shell comprises tabs extending from a rear edge of the shielding shell for engaging and thus securing the housing in the shell.

5. The USB connector as claimed in claim 1, wherein the shielding shell defines holes for engaging corresponding projections formed on the housing for securing the housing inside the shell.

6. The USB connector as claimed in claim 1, wherein the insulative housing comprises a base section and a mating section forwardly extending from a front face of the base section and having opposite surfaces, the passageways being formed in one of the surfaces of the mating section for receiving the corresponding contacts.

7. The USB connector as claimed in claim 1, wherein the insulative housing has a bottom face with a plurality of standoffs formed thereon for supporting the connector on a printed circuit board.

8. An electrical connector comprising:

an insulative housing with a plurality of contacts therein;

a shielding shell enclosing the housing, said shell defining opposite top and bottom walls and two opposite side walls perpendicular to said top and bottom walls; and a pair of rear board locking legs integrally and coplanarily extending downwardly from bottom edges of said side walls, respectively, and a pair of spaced front board locking legs integrally extending downwardly from a front portion of said bottom wall; wherein said pair of front board locking legs are perpendicular to both the bottom wall and the pair of rear board locking legs, and a distance between the pair of front board locking legs is smaller than that of the pair of rear board locking legs.

9. An electrical connector comprising:

an insulative housing with a plurality of contacts therein, said housing defining a bottom face thereof;

a shielding shell enclosing the housing, said shell defining opposite top and bottom walls and two opposite side walls perpendicular to said top and bottom walls; and a pair of board locking legs integrally extending downwardly from bottom edges of the side walls, respectively, another board locking leg integrally extending downwardly from the bottom wall between said pair of board locking legs; wherein said bottom wall is higher than the bottom face, and said another board locking leg extends through and out of said bottom face.

* * * * *